US006800221B2

(12) United States Patent
Jog et al.

(10) Patent No.: US 6,800,221 B2
(45) Date of Patent: Oct. 5, 2004

(54) CONDUCTIVE POLYMER BLEND AND A PROCESS FOR THE PREPARATION THEREOF

(75) Inventors: Jyoti Prakash Jog, Maharashtra (IN); Shrikant Madhukar Kulkarni, Maharashtra (IN); Priya L, Maharashtra (IN); Raghunath Vitthal Chaudhari, Maharashtra (IN)

(73) Assignee: Council of Scientific and Industrial Research, New Delhi (IN)

( * ) Notice: Subject to any disclaimer, the term of this patent is extended or adjusted under 35 U.S.C. 154(b) by 272 days.

(21) Appl. No.: 09/964,534

(22) Filed: Sep. 28, 2001

(65) Prior Publication Data

US 2003/0066986 A1 Apr. 10, 2003

(51) Int. Cl.[7] ..... H01B 1/20

(52) U.S. Cl. ..... 252/500; 264/104

(58) Field of Search ..... 252/500; 264/104

(56) References Cited

U.S. PATENT DOCUMENTS 5,256,335 A * 10/1993 Byrd et al. ..... 252/500
6,203,727 B1 * 3/2001 Babinec et al. ..... 252/500

* cited by examiner

*Primary Examiner*—Mark Kopec
(74) *Attorney, Agent, or Firm*—Burns, Doane, Swecker & Mathis, L.L.P.

(57) ABSTRACT

Conductive polymer blends of linear alternating polymer of carbon monoxide and at least one ethylenically unsaturated hydrocarbon with conductive polymer are disclosed as is a method of preparation thereof. The blends display excellent conductivity even at substantially lower loading of conductive additive.

19 Claims, No Drawings

CONDUCTIVE POLYMER BLEND AND A PROCESS FOR THE PREPARATION THEREOF

FIELD OF THE INVENTION

The present invention relates to a conducting polymer blend and to a process for the preparation thereof. More particularly, the present invention relates to a conductive polymer blend of a major amount of a polyketone polymer and a substantially lesser amount of conducting additive.

BACKGROUND OF THE INVENTION

Electrically conductive materials are of major industrial as well as scientific interest owing to their wide applications in modern electronics and related areas. Conductive materials based on polymers are of even more interest. A particular advantage of polymer based conductive materials is that they exhibit electromagnetic properties similar to metals and also retain their more desirable polymer properties, in particular physical and mechanical properties. Due to their ease of processing, the conducting materials based on polymers are ideal candidates for fabrication of articles intended to facilitate electrostatic discharge such as parts used in home appliances, computers, electronics, and electrical equipment, Unfortunately, not all polymers exhibit enough conductivity as required for some applications. Polyketones for example are relatively recent high performance engineering thermoplastics with established utility in many technologically attractive areas such as the automotive industry. Due to their excellent engineering properties, it would be highly desirable to use materials based on polyketone polymers in a variety of other applications such as electronic instruments, parts of computers and other household appliances. All these and similar applications are expected to facilitate electric discharge in order to prevent electric shock or sparking. A major disadvantage that results in the limited use of polyketone containing materials in such applications is that polyketones are relatively low conducting polymers with conductivities to the order of $10^{-13}$ s/cm or less.

Conducting polyketone materials have been obtained in the prior art by means of blends containing polyketone polymer and inorganic conductive additive such as carbon fiber, metal powder and the like (Byrd, U.S. Pat. No. 5,256,335, to Shell Oil Company). The preparation of polyketone containing conducting materials using even cheaper conductive additives would be a significant advance in the current sate of the art.

The authors of the present invention have comprehensively investigated the possible use of a variety of simple conductive additive materials that can be used in low amounts and still provide better conductive polyketone blends.

OBJECTS OF THE INVENTION

The main object of the invention is to provide a conductive polymer blend comprising of polyketone polymer and a conducting organic polymer.

It is another object of the invention to provide polyketone containing conducting materials using inexpensive conductive additives rendering such blends more economical to manufacture.

Another object of the invention is to provide a process for the preparation of polyketone containing conducting materials using inexpensive conductive additives.

SUMMARY OF THE INVENTION

The present invention provides a conductive polymer blend comprising of polyketones and a conducting organic polymer additive.

Accordingly, the present invention provides a conductive polymer blend comprising of a major amount of a polyketone polymer and a minor amount of a conducting organic polymer as additive.

In one embodiment of the invention, the polyketone polymer is a linear alternating polymer of carbon monooxide and at least one ethylenically unsaturated hydrocarbon.

In another embodiment of the invention, the polyketone polymer is a polymer of the general formula —[—CO—(P—)—]$_n$—[CO—(Q)—]$_m$ wherein n and m are both >0 and P and Q independently consist of unsaturated hydrocarbons selected from the group consisting of ethylene, propylene, styrene, hexene, 1-butene and norbornadiene.

In another embodiment of the invention, the conducting polymer additive is selected from the group consisting of substituted or unsubstituted polyanilines, polyacetylenes, polyvinylpyrrolidine, polyazines, polythiophenes polyphenylene sulfides and polyselenophenes.

In a further embodiment of the invention, the conducting organic polymer is doped with onium salts, iodonium salts, borate salts, organic or inorganic acids or their salts.

The present invention also relates to a process for the preparation of a conductive polymer blend comprising of a major amount of polyketone polymer and a minor amount of a conducting organic polymer additive, said process comprising incorporating the conducting material into the polyketone matrix to uniformly diffuse it therein.

In one embodiment of the invention, the blends are prepared by incorporating the conducting organic polymer additive by melt mixing or solution mixing.

In one embodiment of the invention, the polyketone polymer is a linear alternating polymer of carbon monooxide and at least one ethylenically unsaturated hydrocarbon.

In another embodiment of the invention, the polyketone polymer is a polymer of the general formula —[—CO—(P—)—]$_n$—[CO—(Q)—]$_m$ where n and m are both >0 and P and Q independently consist of unsaturated hydrocarbons selected from the group consisting of ethylene, propylene, styrene, hexene, 1-butene and norbornadiene.

In another embodiment of the invention, the conducting polymer additive is selected from the group consisting of substituted or unsubstituted polyanilines, polyacetylenes, polyvinylpyrrolidine, polyazines, polythiophenes, polyphenylene sulfides and polyselenophenes.

In a further embodiment of the invention, the conducting organic polymer is doped with onium salts, iodonium salts, borate salts, organic or inorganic acids or their salts.

DETAILED DESCRIPTION OF THE INVENTION

The present invention provides a method for the preparation of conducting polyketone blends consisting of a major amount of polyketone polymer and a minor amount of a conducting additive, preferably a conducting organic polymer.

The polyketone polymers employed in the present invention are preferably linear alternating polymers of carbon monoxide with ethylenically unsaturated hydrocarbons and are represented by the general formula —[—CO—(P—)—]$_n$—[CO—(Q)—]$_m$ where n and m are both >0 and P and Q independently consist of unsaturated hydrocarbons. The ethylenically unsaturated hydrocarbons used may have up to 25 carbon atoms although those having less than 10 carbon atoms are preferred. Examples of such ethylenically unsaturated hydrocarbons include ethylene and other α-olefins such as propylene, 1-butene, 1-hexene, 1-dodecene, and the like. Also suitable are other unsaturated hydrocarbons which have an aryl substituent on an otherwise aliphatic molecule particularly, with an aliphatic or aryl substituent on the carbon atom of the ethylene unsaturation. Examples of the latter class of ethylenically unsaturated hydrocarbons include styrene, 4-methylstyrene, 4-ethylstyrene, and the like. Compounds comprising one of more heteroatoms such as vinyl acetate, methyl methacrylate, acrylonitrile and the like may also be employed. When copolymers are employed, there is no third unsaturated hydrocarbon added. Examples of such polyketone polymers include (ethylene —CO)$_n$, (propylene —CO)$_n$, (styrene —CO)$_n$ and the like. Examples of preferred ter-polymers include [(ethylene-(CO)$_n$-(propylene —CO)$_m$] and the like. In case of ter-polymers, the individual —(—P—CO—)— and —(—Q—CO—)— units may be randomly distributed throughout may be randomly distributed throughout the polymer chain and do not appear to influence the polymer properties to a considerable extent.

Such perfectly alternating polyketones can be prepared using documented literature procedures. For example, U.S. Pat. No. 4,843,144, which is incorporated herein by reference provides a method for the preparation of alternating copolymers of carbon monoxide with at least one ethylenically unsaturated hydrocarbon by using a catalyst based on Group VIII metals. U.S. Pat. No. 4,868,282 which is also incorporated herein by reference, provides a method for obtaining alternating ter-polymers by contacting carbon monoxide and ethylene in presence of one or more ethylenically unsaturated hydrocarbons using Group VIII metal catalysts.

The conductive additive employed is a conducting organic polymer. Variety of conducting organic polymers can be used as additives, such as polyanilines, polyvinylphenylenes, polythiophenes, polyselenophenes, polyacetylenes, polyazines, polyhenylsulfides, polypyrroles and the like. These polymers may be unsubstituted or substituted with a variety of groups. The conducting polymers employed may be doped with a variety of dopants such as onium salts, indonium salts, borate salts, organic or inorganic acids or their salts. The doping specie is preferably capable of dissociating on the application of energy such as electromagnetic radiation, electron beam, electricity or heat. The dissociated specie further dopes the organic polymer to make it electrically conductive.

An advantageous feature of this invention is that the conductive blends of polyketone polymers are obtained at comparatively low loading of conductive additive. There is no real limit on the amount of conductive additive used and this may vary in a wide range according to specific needs. The polyketone blends containing up to 70% of conductive additive loading are preferred.

The conductive polyketone blends of the invention can be prepared by any method capable of achieving uniform distribution of additive conductive material throughout the polymer network. In one of the preferred methods, the conductive polyketone blends are prepared by dispersing the polyketone polymer and the additive conductive polymer in an inert solvent such as m-cresol and then evaporating the solvent or precipitating the blend by addition of yet another non-reacting solvent. In a further preferred method the uniform mixture of polyketone and additive material is press cast in the desired shape. Yet another method to incorporate the conductive organic polymer additive into the polyketone polymer is by melt processing the desired amounts of polyketone polymer and conductive additive.

An advantageous feature of the invention, a wide variety of other additives such as colorants, stabilisers, antioxidants, fillers and the like may be used to improve the physical and mechanical properties of the conducting blends at any stage of their preparation an in varied amounts depending on the desire of the user, without affecting the expected conductivity properties.

The following examples are illustrative and should not be construed as limiting the scope of the invention in any manner.

EXAMPLE 1

A linear alternating copolymer of ethylene and carbon monoxide was prepared as follows. A 600 ml capacity stainless steel reactor was charged with the following: palladium acetate (15 mg); 1,3-bisdiiphenylphosphinopropane (dppp) (25.5 mg); p-toluenesulphonic acid (pTSA) (24.9 mg); methanol (200 ml) (water content 800 ppm). The contents of the reactor were then flushed with nitrogen twice to ensure the removal of any undissolved oxygen and then heated under low stirring speed to 90° C. After attainment of this temperature, the autoclave was pressurised to 500 psig of ethylene—CO mixture (1:1) and the agitation was switched to 900 rpm. The co-poolymerisation reactor was then fed with 1:1 mixture of CO and ethylene till the end of the reaction. The co-polymerisation was continued for 4.5 hours. After that the reactor was cooled down to room temperature and the excess gases were vented off. The polymer was obtained as white insoluble powder which was then filtered, washed with methanol twice and dried under vacuum. Yield was 35 gm. The polymer sample had a melting point of 255° C. The intrinsic viscosity measure in m-cresol at 30° C. at a concentration of 0.5 gm/l was 0.95 dL/g, the copolymer as prepared was used for further studies.

EXAMPLE 2

HCl doped polyaniline (PANI) was used as conductive additive material. Two conductive compositions (15 and 5% of PANI) were prepared by thoroughly mixing the requisite amounts of PANI and polyketone polymer. Compacted discs (1.8 cm in diameter and 0.25 mm in thickness) were prepared by compacting the mixture in a mould under pressure of 4 tons for 3 minutes. Surface conductivity was measured using four probe method at room temperature. The conductivity of polyketones was less than $10^{-13}$ S/cm. The average values for conductivity of these two compositions were as follows:

TABLE 1

| % Composition (by weight) | | Conductivity |
|---|---|---|
| Polyketone | Polyaniline | S/cm |
| 99 | 1 | $1.6 \times 10^{-2}$ |
| 95 | 5 | $9.7 \times 10^{-2}$ |

These results clearly indicate that the conductivity of the said polyketone blend increases with the amount of conducting additive and thus, materials with desired conductance can be prepared by adjusting the nature and amount of the conductive additive.

ADVANTAGE OF THE INVENTION

1. Conductive polyketone compositions containing organic polymer as the conducting additive prepared for the first time.
2. The product is obtained economically since the cost of the conductive additive used is less than that of prior art additives.
3. The conductivity level obtained is excellent even with substantially lower loadings of the conductive polymer additive.

We claim:

1. A conductive polymer blend comprising of a major amount of a polyketone polymer and a minor amount of a conducting organic polymer as additive.

2. A conductive polymer blend as claimed in claim 1 wherein the polyketone polymer is a linear alternating polymer of carbon monoxide and at least one ethylenically unsaturated comonomer.

3. A conductive polymer blend as claimed in claim 2 wherein the polyketone polymer is a terpolymer of the general formula $—[—CO—(P—)—]_n—[CO—(Q)—]_m$ where n and m are both >0 and P and Q independently consist of ethylenically unsaturated hydrocarbons.

4. A conductive polymer blend as claimed in claim 3, wherein in the ter-polymers, the individual —(—P—CO—)— and —(—Q—CO—)— units are randomly distributed throughout the polymer chain.

5. A conductive polymer blend as claimed in claim 2 wherein the ethylenically unsaturated comonomers used are selected from the group consisting of α-olefins, unsaturated hydrocarbons with an aryl substituent on an otherwise aliphatic molecule, and compounds comprising one or more heteroatoms.

6. A conductive blend according to claim 5, wherein the compound comprising one or more heteroatoms is selected from the group consisting of vinyl acetate, methyl methacrylate and acrylonitrile.

7. A conductive polymer blend as claimed in claim 2, wherein the ethylenically unsaturated comonomer is selected from the group consisting of ethylene, propylene, styrene, hexene, 1-butene and norbornadiene.

8. A conductive polymer blend as claimed in claim 1 wherein the conducting polymer additive is selected from the group consisting of substituted or unsubstituted polyanilines, polyacetylenes, polyvinylpyrrolidine, polyazines, polythiophenes, polyphenylene sulfides and polyselenophenes.

9. A conductive polymer blend as claimed in claim 8 wherein the conducting organic polymer used is doped with at least one of onium salts, iodonium salts, borate salts, organic or inorganic acids or their salts.

10. A process for the preparation of a conductive polymer blend comprising of a major amount of polyketone polymer and a minor amount of a conducting organic polymer additive, said process comprising incorporating the conducting material into the polyketone matrix to uniformly diffuse it therein.

11. A process as claimed in claim 10 wherein the blends are prepared by incorporating the conducting organic polymer additive by melt mixing or solution mixing.

12. A process as claimed in claim 10 wherein the polyketone polymer is a linear alternating polymer of carbon monoxide and at least one ethylenically unsaturated comonomer.

13. A process as claimed in claim 12, wherein the ethylenically unsaturated comonomers used are selected from the group consisting of α-olefins, unsaturated hydrocarbons with an aryl substituent on an otherwise aliphatic molecule and compounds comprising one or more heteroatoms.

14. A process according to claim 13, wherein the compound comprising one or more heteroatoms is selected from the group consisting of vinyl acetate, methyl methacrylate and acrylonitrile.

15. A process as claimed in claim 12, wherein the ethylenically unsaturated comonomer is selected from the group consisting of ethylene, propylene, styrene, hexene, 1-butane and norbornadiene.

16. A process as claimed in claim 10 wherein the polyketone polymer is a terpolymer of the general formula $—[—CO—(P—)—]_n—[CO—(Q)—]_m$ where n and m are both >0 and P and Q independently consist of ethylenically unsaturated hydrocarbons.

17. A process as claimed in claim 16, wherein in the ter-polymers, the individual —(—P—CO—)— and —(—Q—CO—)— units are randomly distributed throughout the polymer chain.

18. A process as claimed in claim 10 wherein the conducting polymer additive is selected from the group consisting of substituted or unsubstituted polyanilines, polyacetylenes, polyvinylpyrrolidine, polyazines, polythiophenes, polyphenylene sulfides and polyselenophenes.

19. A process as claimed in claim 18 wherein the conducting organic polymer used is doped with at least one of onium salts, iodonium salts, borate salts, organic or inorganic acids or their salts.

* * * * *